US009433296B2

(12) United States Patent
Gorgi

(10) Patent No.: US 9,433,296 B2
(45) Date of Patent: Sep. 6, 2016

(54) DEVICE FOR QUICKLY MOUNTING A BACK REST ON A MECHANISM FOR OFFICE CHAIRS

(71) Applicant: IMARC S.p.A., Rossano Veneto (VI) (IT)

(72) Inventor: Claudio Gorgi, Rossano Veneto (VI) (IT)

(73) Assignee: IMARC S.P.A., Rossano Veneto (VI) (IT)

( * ) Notice: Subject to any disclaimer, the term of this patent is extended or adjusted under 35 U.S.C. 154(b) by 0 days.

(21) Appl. No.: 14/896,476

(22) PCT Filed: Jul. 1, 2014

(86) PCT No.: PCT/EP2014/063971

§ 371 (c)(1),
(2) Date: Dec. 7, 2015

(87) PCT Pub. No.: WO2015/000904

PCT Pub. Date: Jan. 8, 2015

(65) Prior Publication Data

US 2016/0128483 A1 May 12, 2016

(30) Foreign Application Priority Data

Jul. 3, 2013 (IT) ..... VE2013A0034

(51) Int. Cl.

| | |
|---|---|
| ***A47C 7/02*** | (2006.01) |
| ***A47C 7/42*** | (2006.01) |
| ***A47C 7/46*** | (2006.01) |
| ***A47C 3/025*** | (2006.01) |

(Continued)

(52) U.S. Cl.
CPC ..... *A47C 4/021* (2013.01); *A47C 1/03238* (2013.01); *A47C 7/42* (2013.01)

(58) Field of Classification Search
CPC ..... A47C 1/03238; A47C 7/42; A47C 4/021
USPC ..... 297/285, 296, 297, 300.1, 300.2, 300.5, 297/301.1, 301.4, 301.5, 440.15
See application file for complete search history.

(56) References Cited

U.S. PATENT DOCUMENTS 5,333,368 A * 8/1994 Kriener ..... A47C 1/024 297/302.1
5,782,536 A * 7/1998 Heidmann ..... A47C 1/023 297/300.2

(Continued)

FOREIGN PATENT DOCUMENTS

EP 0934716 A2 8/1999
WO WO04000075 A2 12/2003

*Primary Examiner* — Rodney B White
(74) *Attorney, Agent, or Firm* — Themis Law

(57) ABSTRACT

A device for connecting a back rest to the seating portion support mechanism for chairs includes a first part pertaining to the mechanism, a second part pertaining to the back rest, a pair of pins, at least one of which is applied to the first part (second part), a pair of open slots, at least one of which pertains to the second part (first part), the slots forming housings for the pins, an elastic member acting on at least one of the pins or the housings, the distance between the axes of the pins or the housings being modifiable temporarily against the action of the elastic member, wherein the open slots present an inclined surface which, by acting against one of the pins, causes a temporary modification of the distance between axes of the pins, so facilitating engagement of the pin in the housing seat.

7 Claims, 7 Drawing Sheets

(51) Int. Cl.

| | |
|---|---|
| ***A47C 3/026*** | (2006.01) |
| ***A47C 4/02*** | (2006.01) |
| ***A47C 1/032*** | (2006.01) |

(56) References Cited

U.S. PATENT DOCUMENTS

| | | | | |
|---|---|---|---|---|
| 6,224,160 | B1 * | 5/2001 | Takeuchi | A47C 3/00 297/440.15 |
| 6,554,366 | B2 * | 4/2003 | Zeeuw | A47C 7/42 297/440.15 |
| 6,585,320 | B2 * | 7/2003 | Holbrook | A47C 3/026 297/440.15 X |
| 6,945,602 | B2 * | 9/2005 | Fookes | A47C 1/03255 297/300.2 |
| 7,614,697 | B1 * | 11/2009 | Lai | A47C 1/03255 297/301.1 |
| 7,959,232 | B2 * | 6/2011 | Sawada | B60N 2/686 297/440.15 X |
| 8,613,482 | B2 * | 12/2013 | Ni | A47C 1/026 297/302.1 |
| 9,241,570 | B2 * | 1/2016 | Jones | A47C 1/03255 |
| 2001/0002763 | A1 * | 6/2001 | Roberts | A47C 7/42 297/440.15 X |
| 2008/0054700 | A1 | 3/2008 | Meidan | |
| 2009/0218864 | A1 * | 9/2009 | Parker | A47C 1/023 297/300.2 |
| 2011/0291452 | A1 | 12/2011 | Ko | |
| 2013/0221719 | A1 * | 8/2013 | Costaglia | A47C 1/03294 297/340 |

* cited by examiner

DEVICE FOR QUICKLY MOUNTING A BACK REST ON A MECHANISM FOR OFFICE CHAIRS

FIELD OF THE INVENTION

The present invention relates to a device for quickly mounting a back rest on a mechanism for office chairs.

BACKGROUND OF THE INVENTION

Office chairs are known generally consisting of a support base provided with wheels or with a rotatable column of variable height, the upper end of which is inserted into a box support, the interior of which houses the adjustment mechanisms for the seating portion and back rest. The seating portion and back rest are generally securely coupled to their supports by suitable screws.

Solutions are currently sought for simplifying and accelerating the assembly of these components to enable self-assembly of the structure by the final user, by enabling the components (back rest, seating portion, support boxes, column and spokes) to be sent separately to achieve low-cost packaging and transport. Consequently the ability to reduce the size and weight of these components is of fundamental importance in achieving competitive products of quality.

In swivel chairs the back rest is hinged to a support box and supported in the movements which the user imposes on it by an elastic support element able to withstand the user's weight.

SUMMARY OF THE INVENTION

The object of the invention is to provide a device which enables the back rest to be easily and quickly mounted on the support box, while at the same time enabling the back rest to be rotated rearwards.

This object is attained according to the invention by a device for quickly mounting a back rest on a mechanism for office chairs as described hereinafter.

BRIEF DESCRIPTION OF THE DRAWINGS

The present invention is further clarified hereinafter with reference to the accompanying drawings, in which.

DETAILED DESCRIPTION OF EMBODIMENTS OF THE INVENTION

Figure 1:
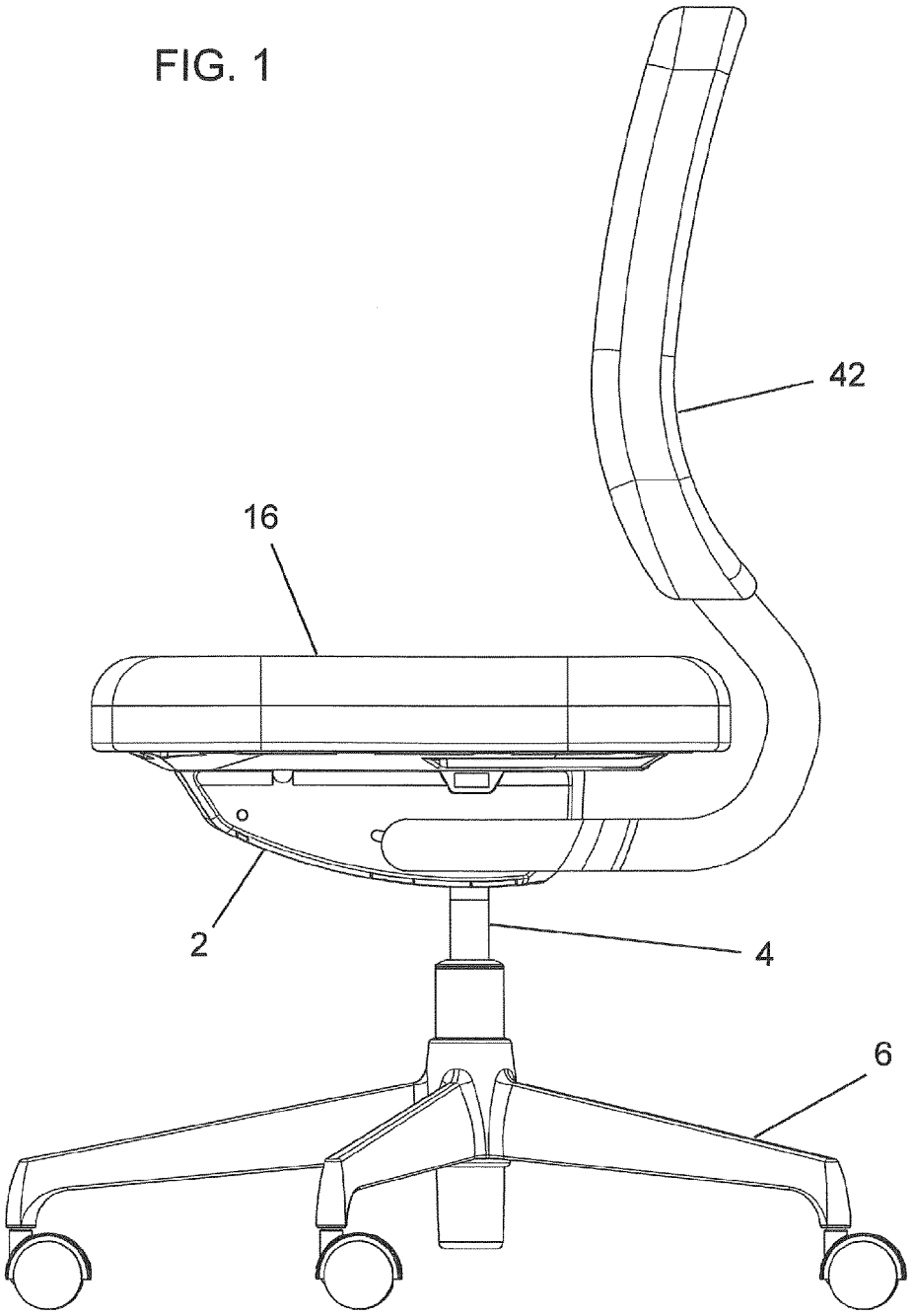
FIG. 1 is a schematic view of a chair provided with the device according to the invention.
Figure 2:
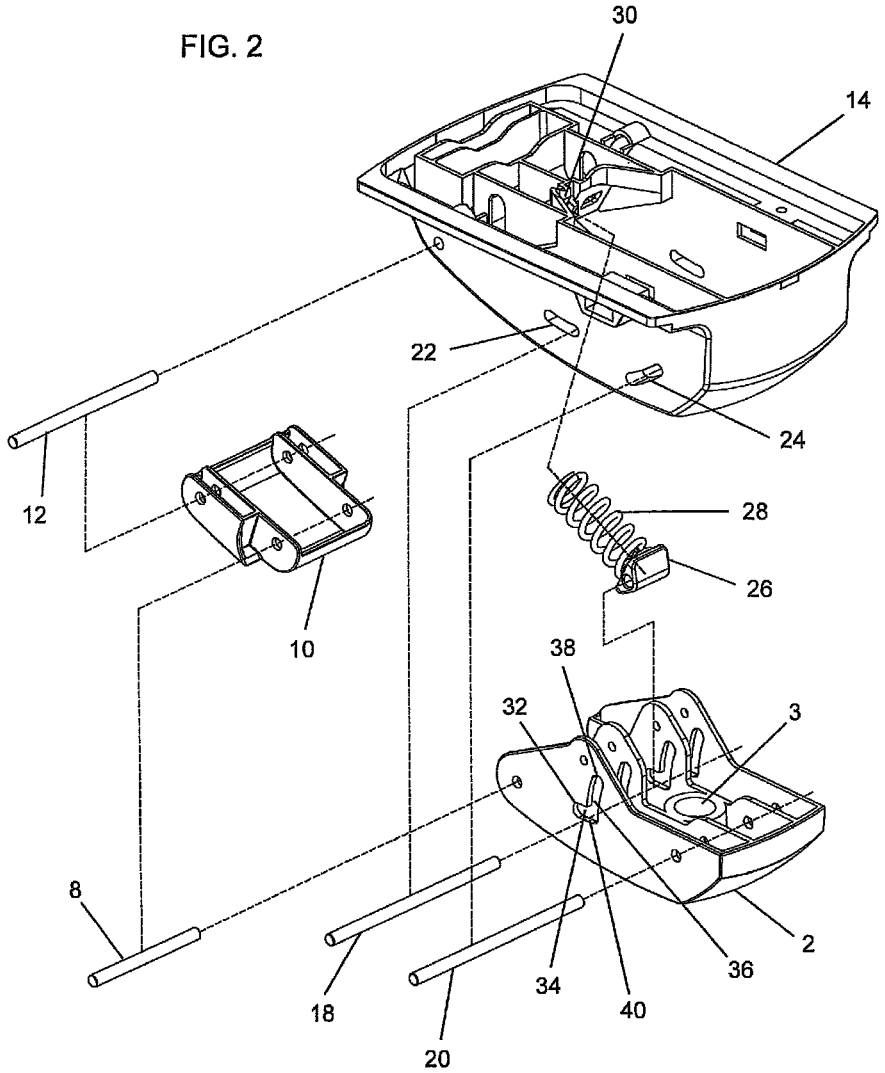
FIG. 2 is an exploded perspective view showing the support box with the hinge mechanism.
Figure 3:
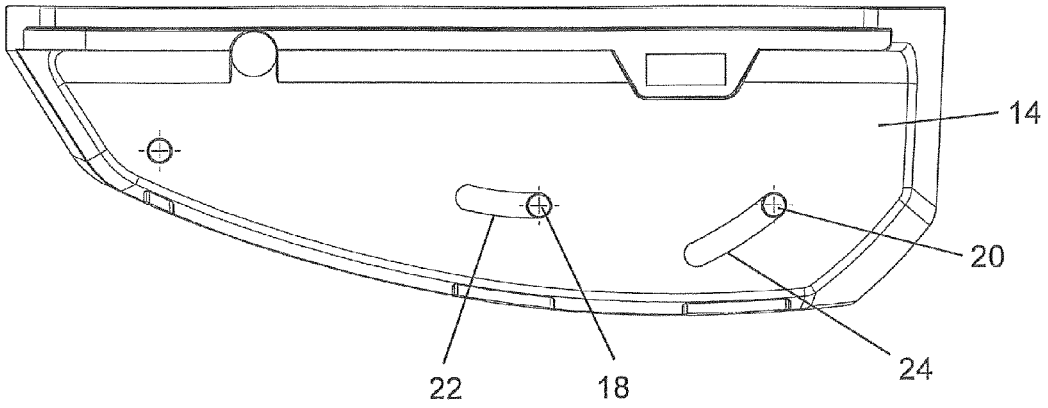
FIGS. 3, 4 and 5 show longitudinal sections through the support box with the hinge mechanism.
Figure 4:
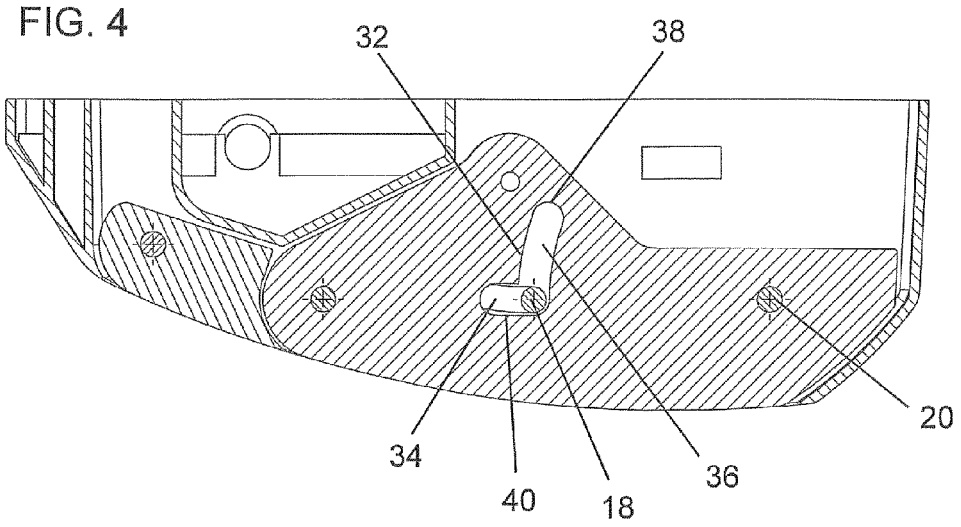
Figure 5:
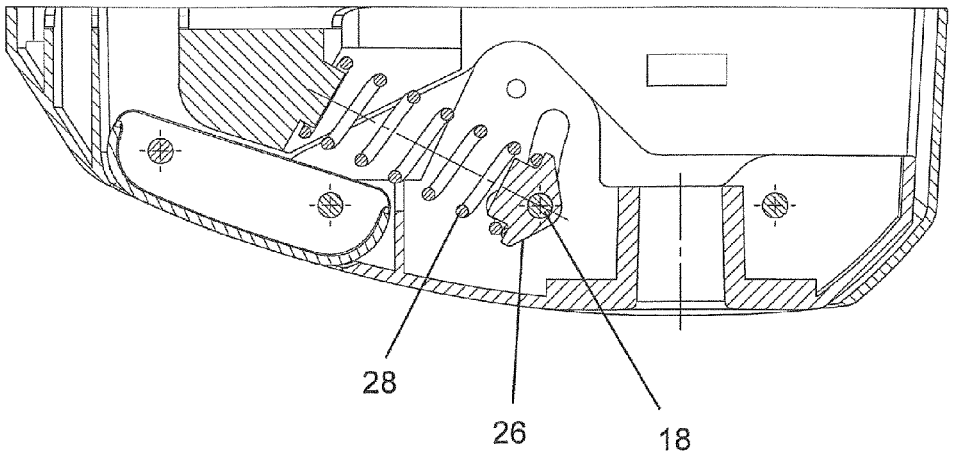
Figure 6:
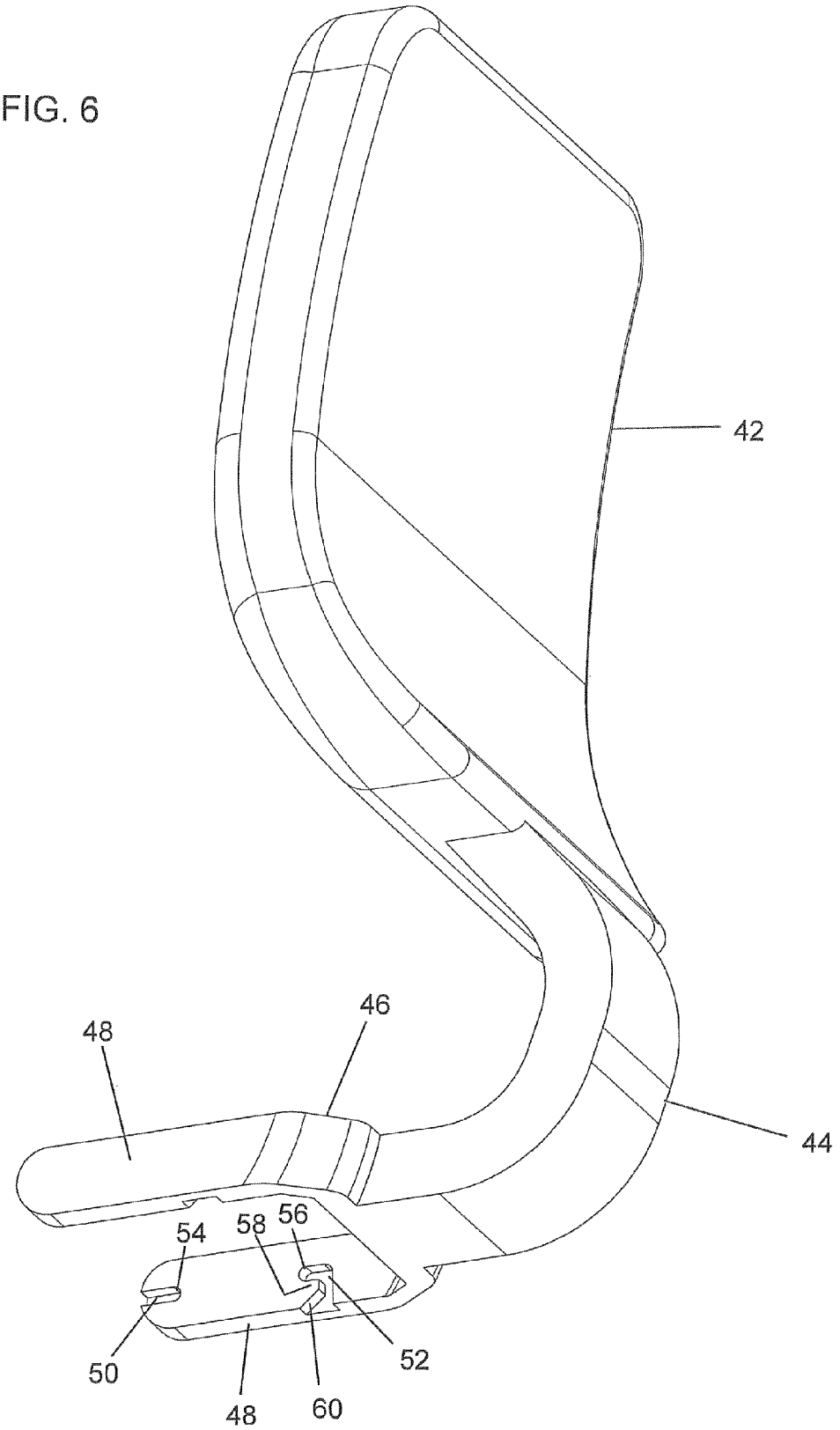
FIG. 6 is a perspective view of the back rest.
Figure 7:
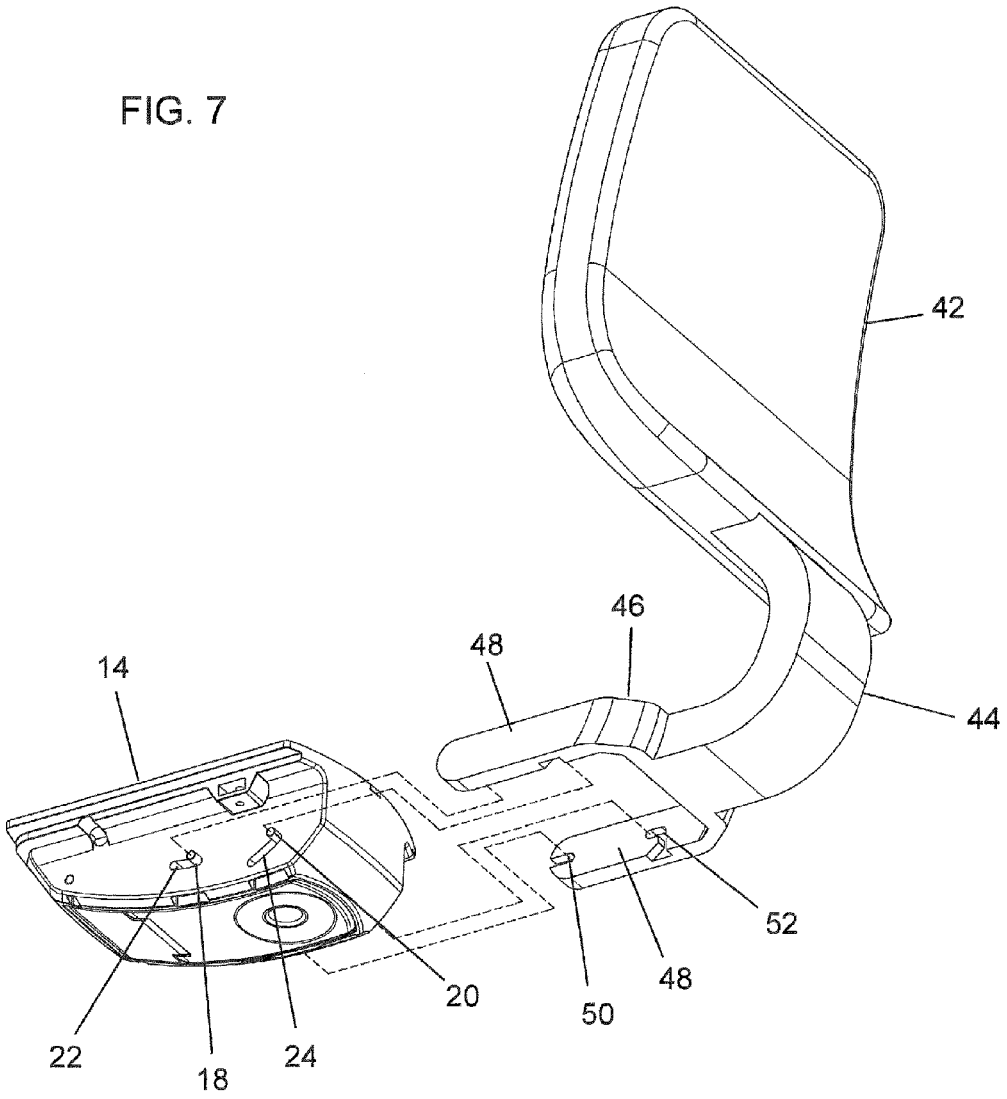
FIG. 7 shows the back rest during its application to the box with the mounting mechanism.

As can be seen from the figures, the device according to the invention is applied to a mechanism for office chairs, it consisting of a swivel support comprising a fixed box structure 2 provided lowerly with a frusto-conical socket 3 for the insertion of the upper end of a column 4 of a traditional gas pump, the purpose of which is to support the swivel support on a support base 6.

A connecting piece 10 is pivoted on a pin 8 to the fixed box structure 2 and is also pivoted on a pin 12 to the plate 14 which supports the chair seating portion 16.

The plate 14 is also hinged to the fixed box structure 2 by two pins 18, 20 inserted in two slotted holes 22 and 24 provided in the lateral wall of the plate 14.

The pin 20 is rigid with the fixed box structure 2.

A spring support 26 housed within the fixed box 2 is mounted on the pin 18, and on it there acts a coil spring 28 acting against a transverse baffle 30 provided in the plate 14.

The pin 18 is also inserted into the fixed box structure 2, passing through a pair of L-shaped slots 32 formed in a lateral wall thereof and forming a longitudinal first branch 34 and a vertical second branch 36 presenting two striker surfaces 38 and 40 at its upper and lower ends.

By the effect of the slot 22 and the elastic counteraction of the spring 28, the pin 18 lies in the intermediate position within the slot 32 when the chair is unassembled and unstressed.

The invention also comprises a back rest 42 provided with a bracket 44 provided at its end with a fork 46, the prongs 48 of which are provided with a front longitudinal cavity 50 having a housing seat 54 and with a substantially inverted L-shaped rear cavity 52 provided with a housing seat 56.

Figure 8:
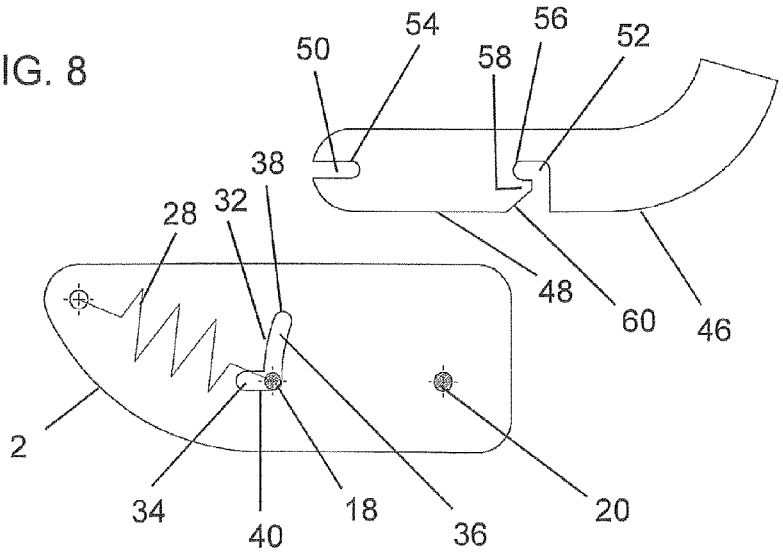
FIGS. 8, 9, 10, 11 and 12 show schematically the steps in assembling the back rest to the box structure.
Figure 9:
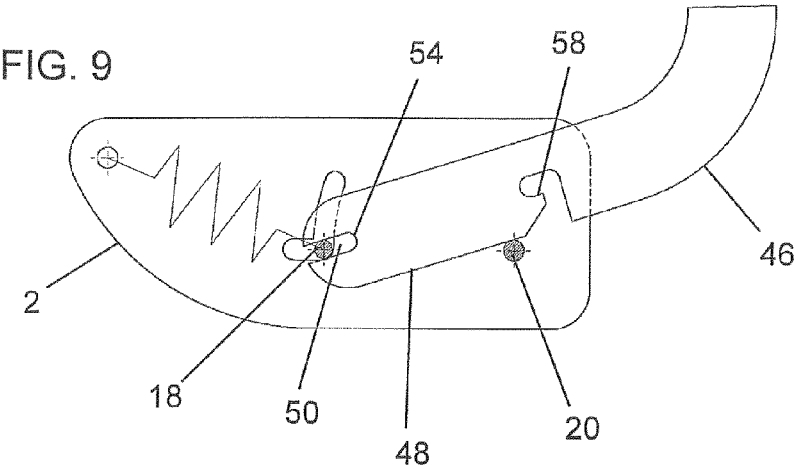
Figure 10:
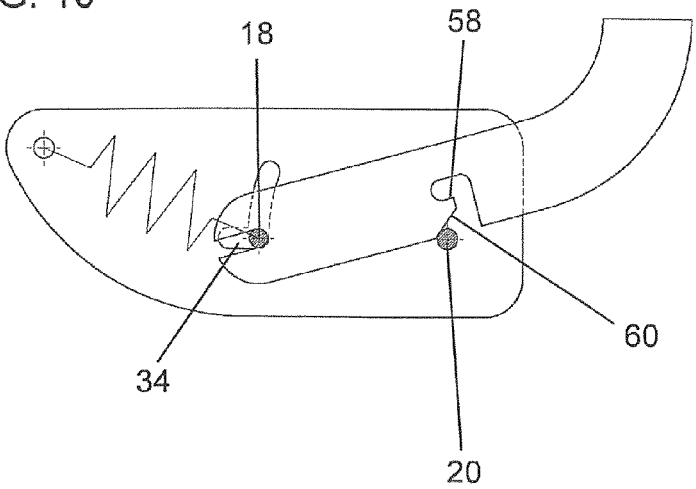

To fit the back rest to the support box, the procedure is as follows: the prongs 48 are positioned to the sides of the structure 2 and above the pin 20, such that the ends of the pin 18 engage in the housing seats 54 of the cavities 50, so that the pin 20 is also able to engage the surface 60 of the cavities 52 (see FIGS. 8-10).

On applying a downward rotation to the back rest, the prongs 48 are compelled to undergo a longitudinal movement, with the pin 18 consequently sliding along the horizontal branch 34 of the slot 32.

Figure 11:
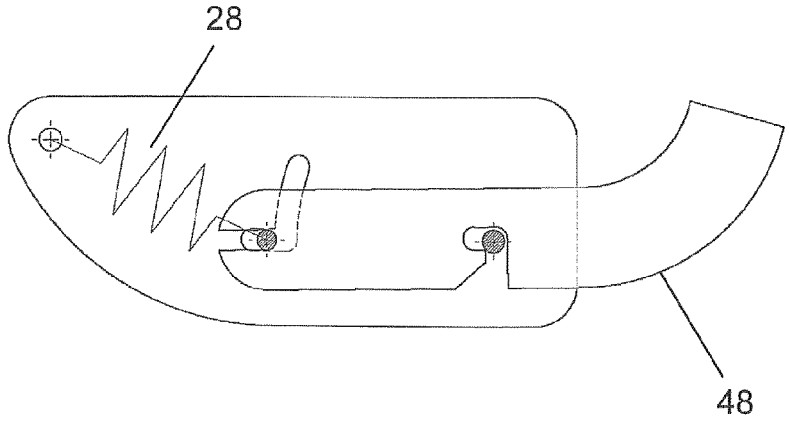
Figure 12:
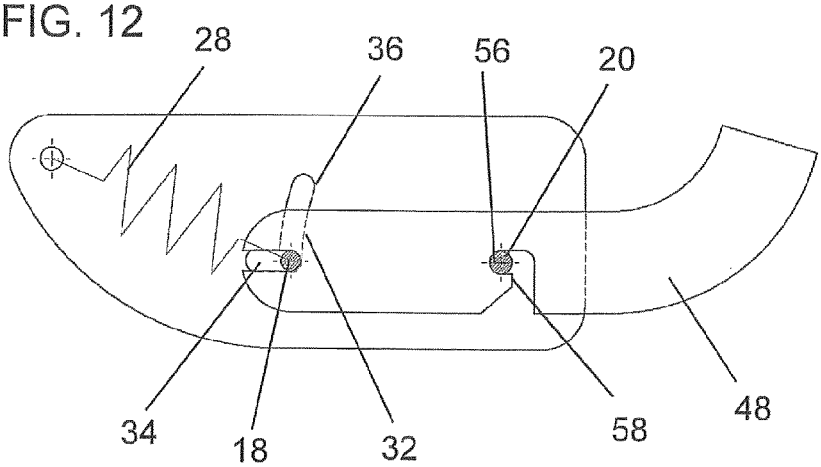

As a result of this sliding, the pin 18 temporarily compresses the spring 28 until the pin 20, by overcoming the tooth 58 of the cavity 52, jumps into the housing seat 56, to securely lock the back rest 42 relative to the box 2 (see FIGS. 11 and 12).

A rearward thrust by the user causes the back rest 42 to rotate about the fixed pin 20, with the movable pin 18, guided by the housing seat 54 of the back rest 42 compressing the spring 28, and rising along the vertical branch 36 of the slot 32 of the fixed box structure 2, to halt its movement against the striker surface 38.

Figure 13:
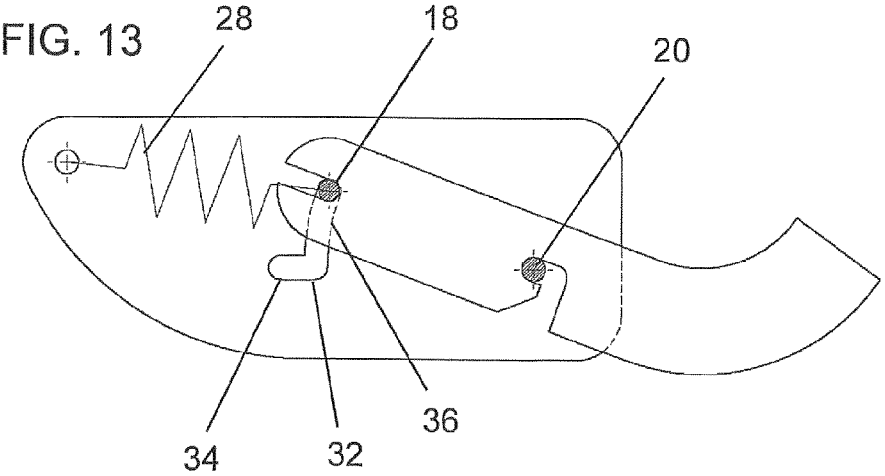
FIG. 13 shows schematically the stage of rearward rotation of the back rest.

All this ensures that during normal use the back rest is unable to disengage from the support (see FIG. 13). When the back rest needs to be released, it is urged from the rear, but being unable to rotate, it causes the pin 18 to slide along the horizontal branch 34 of the slot 32, so compressing the spring 28 and releasing the pin 20 from the housing seat 56. As soon as the pin 20 overcomes the tooth 58 with an upward rotation, it disengages from the cavity 52 to enable the back rest 42 to be released.

From the aforegoing it is apparent that the device according to the invention presents numerous advantages, and in particular:

it enables weights and dimensions to be limited, hence economizing storage and transport in that the chairs can be transported disassembled and be assembled and disassembled quickly and easily, it enables the number of components to be limited in that the spring and pins utilized by the linkage mechanism are used to enable the back rest to be easily connected to the chair structure.

The invention claimed is:

1. A device for connecting a back rest to a seating portion support mechanism for chairs, comprising:

a first part (2) configured to be coupled to the support mechanism;

a second part (46) configured to be coupled to the back rest (42);

a pair of pins (18, 20), at least one of which is coupled to the first part or the second part;

a pair of open slots (50, 52), at least one of which is defined in the second part or respectively the first part, said slots forming housing seats (54, 56) for said pins (18, 20); and an elastic member (28) acting on at least one of said pins, a distance between axes of said pins being altered temporarily by compressing said elastic member (28) during engagement of said second part (46) in said first part (2), wherein said open slots (50, 52) have an inclined surface (60) which, by acting against one of said pins (18, 20), causes a temporary modification of the distance between the axes of said pins, thereby facilitating engagement of said pin (18, 20) in said housing seat (54, 56), wherein at least one of said pins (18, 20) moves along a slotted aperture (32) of said first part (2), wherein said slotted aperture (32) comprises striking surfaces (38, 40) which form limit stops for a rotation of one of said pins (18) about another one of said pins (20), and wherein there are two slotted apertures (32) which are formed from a first branch (34) along which said pins (18, 20) slide, and from a second branch (36) enabling said second part (46) to swivel about said first part (2).

2. The device as claimed in claim 1, wherein at least one of said pins (18, 20) forms a hinging axis of said second part (46) about said first part (2).

3. A device for connecting a back rest to a seating portion support mechanism for chairs, comprising:

a first part (2) configured to be coupled to the support mechanism;

a second part (46) configured to be coupled to the back rest (42);

a pair of pins (18, 20), at least one of which is coupled to the first part or the second part;

a pair of open slots (50, 52), at least one of which is defined in the second part or respectively the first part, said slots forming housing seats (54, 56) for said pins (18, 20); and an elastic member (28) acting on at least one of said pins, a distance between axes of said pins being altered temporarily by compressing said elastic member (28) during engagement of said second part (46) in said first part (2), wherein said open slots (50, 52) have an inclined surface (60) which, by acting against one of said pins (18, 20), causes a temporary modification of the distance between the axes of said pins, thereby facilitating engagement of said pin (18, 20) in said housing seat (54, 56), and wherein said slots (50, 52) have a tooth (58) forming an obstacle to an escape of said pin (18, 20) from said slots.

4. The device as claimed in claim 1, wherein said elastic member also counteracts a swivelling of said back rest (42) relative to said seating portion (16).

5. A device for connecting a back rest to a seating portion support mechanism for chairs, comprising:

a first part (2) configured to be coupled to the support mechanism;

a second part (46) configured to be coupled to the back rest (42);

a pair of pins (18, 20), at least one of which is coupled to the first part or the second part;

a pair of open slots (50, 52), at least one of which is defined in the second part or respectively the first part, said slots forming housing seats (54, 56) for said pins (18, 20); and an elastic member (28) acting on at least one of said pins, a distance between axes of said pins being altered temporarily by compressing said elastic member (28) during engagement of said second part (46) in said first part (2), wherein said open slots (50, 52) have an inclined surface (60) which, by acting against one of said pins (18, 20), causes a temporary modification of the distance between the axes of said pins, thereby facilitating engagement of said in (18, 20) in said housing seat (54, 56), and wherein said pins (18, 20) are also engaged in slots (22, 24) of a plate (14) hinged to said first part (2) and supporting the seating portion.

6. The device as claimed in claim 5, wherein said elastic member (28) is connected to said plate (14).

7. The device as claimed in claim 6, wherein at least one of said pins (18, 20) moves along a slotted aperture (32) of said first part (2), wherein said slotted aperture (32) comprises striking surfaces (38, 40) which form limit stops for a rotation of one of said pins (18) about another one of said pins (20), and wherein said striking surfaces (40) are parallel to a sliding surface of the slot (22).

* * * * *